United States Patent [19]

Evans

[11] Patent Number: 4,721,147

[45] Date of Patent: Jan. 26, 1988

[54] APPARATUS FOR FORMING SMALL OBJECTS SUCH AS BULLETS

[76] Inventor: James P. Evans, 503 Washington St., Cedar Falls, Iowa 50613

[21] Appl. No.: 677,512

[22] Filed: Dec. 3, 1984

[51] Int. Cl.[4] ..... B22D 17/10; B22D 18/02; B22D 27/11

[52] U.S. Cl. ..... 164/155; 72/44; 164/154; 164/284; 164/313

[58] Field of Search ..... 164/457, 120, 149, 155, 164/313, 284, 4.1, 154, 157, 319; 72/44

[56] References Cited

U.S. PATENT DOCUMENTS

| | | | |
|---|---|---|---|
| 34,006 | 12/1861 | Naylor | 164/120 |
| 660,221 | 10/1900 | Potter | 164/120 |
| 4,223,718 | 9/1980 | Miki et al. | 164/149 |
| 4,469,164 | 9/1984 | Ishikawa et al. | 164/457 |

*Primary Examiner*—Nicholas P. Godici
*Assistant Examiner*—J. Reed Batten, Jr.
*Attorney, Agent, or Firm*—James C. Nemmers

[57] ABSTRACT

A method and apparatus for making small lead objects such as bullets. Lead is melted and while in a molten state is pumped through a metering device that regulates the amount fed into a die where it solidifies. Force is immediately applied to the still-soft lead to form the hard bullet.

5 Claims, 4 Drawing Figures

APPARATUS FOR FORMING SMALL OBJECTS SUCH AS BULLETS

BACKGROUND OF THE INVENTION

Typically commercial processes for making lead bullets employ an extrusion process to form a continuous ribbon of lead which can then be cut off into individual pieces which pieces are then swaged to form bullets. Machines for performing the typical commercial process are quite expensive, and they require several handling steps of the lead throughout the process. This extra handling further adds to the cost of manufacture of the bullets. This typical process results in what are known as soft bullets.

Because soft bullets leave lead deposits in the barrel of the gun, hard bullets are preferred over the soft bullets. However, hard bullets must be produced by a cast process in which molten lead is poured into molds and allowed to solidify. Such processes are relatively slow, and bullets produced by the casting process are therefore more expensive.

There is therefore a need for a process and a machine which can produce hard bullets at a rate comparable to the commercially typical commercial extrusion process and at a competitive cost.

SUMMARY OF THE INVENTION

The method and apparatus of the invention provide a way of producing hard lead bullets at a lower cost and at rates comparable to the typical extrusion process. Using the process of the invention, lead in a molten state is pumped through a metering device that regulates the amount of lead fed into one or more dies. When injected into the dies, the molten lead solidifies, and it is immediately swaged by the application of extremely high pressure. As a part of the process, a lubricant is injected into the die prior to metering the molten lead into the die, and when pressure is applied to the solidified but still soft lead, the lubricant is forced into the surface of the bullet. With the process of the invention, the lead is not handled from the time it is placed into a melter until the formed bullet is ejected from the forming dies.

DESCRIPTION OF THE PREFERRED EMBODIMENT OF THE INVENTION

Figure 2:
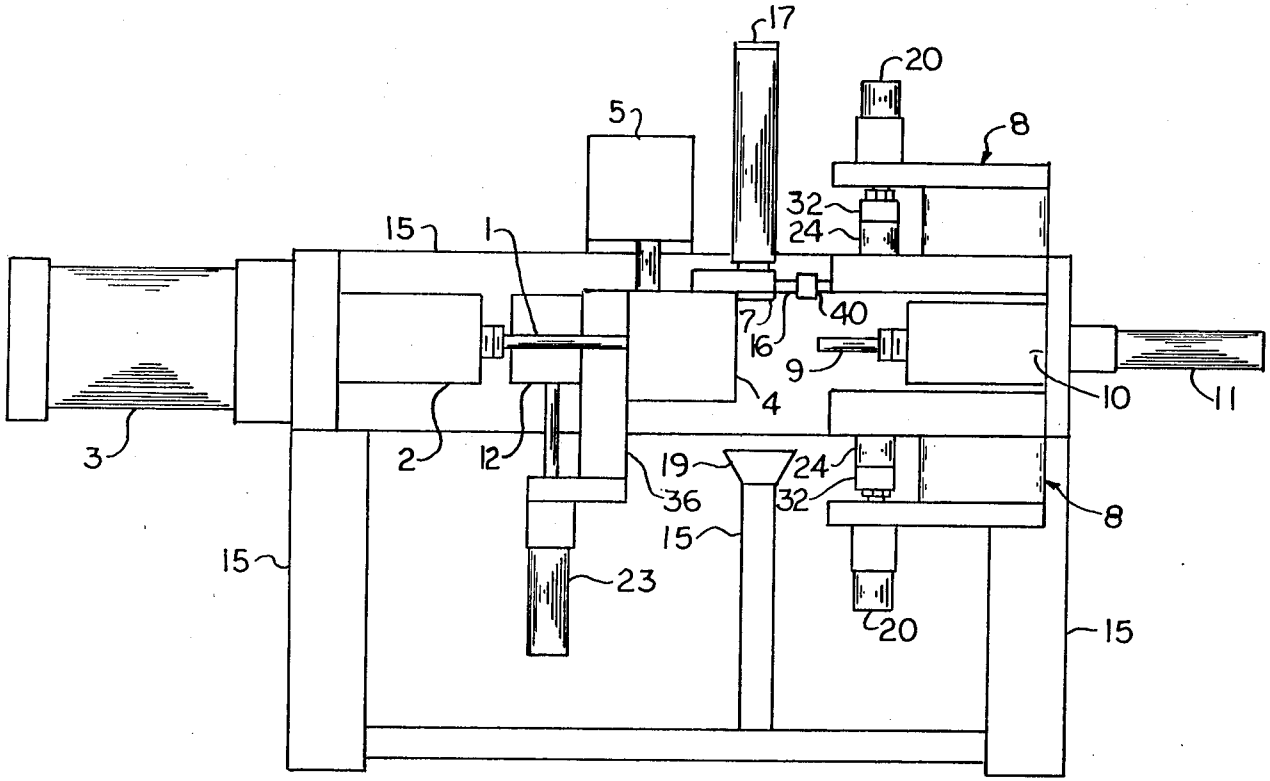
FIG. 2 is a side elevational view, partly in section, of an apparatus for forming bullets according to the principles of the invention.
Figure 3:
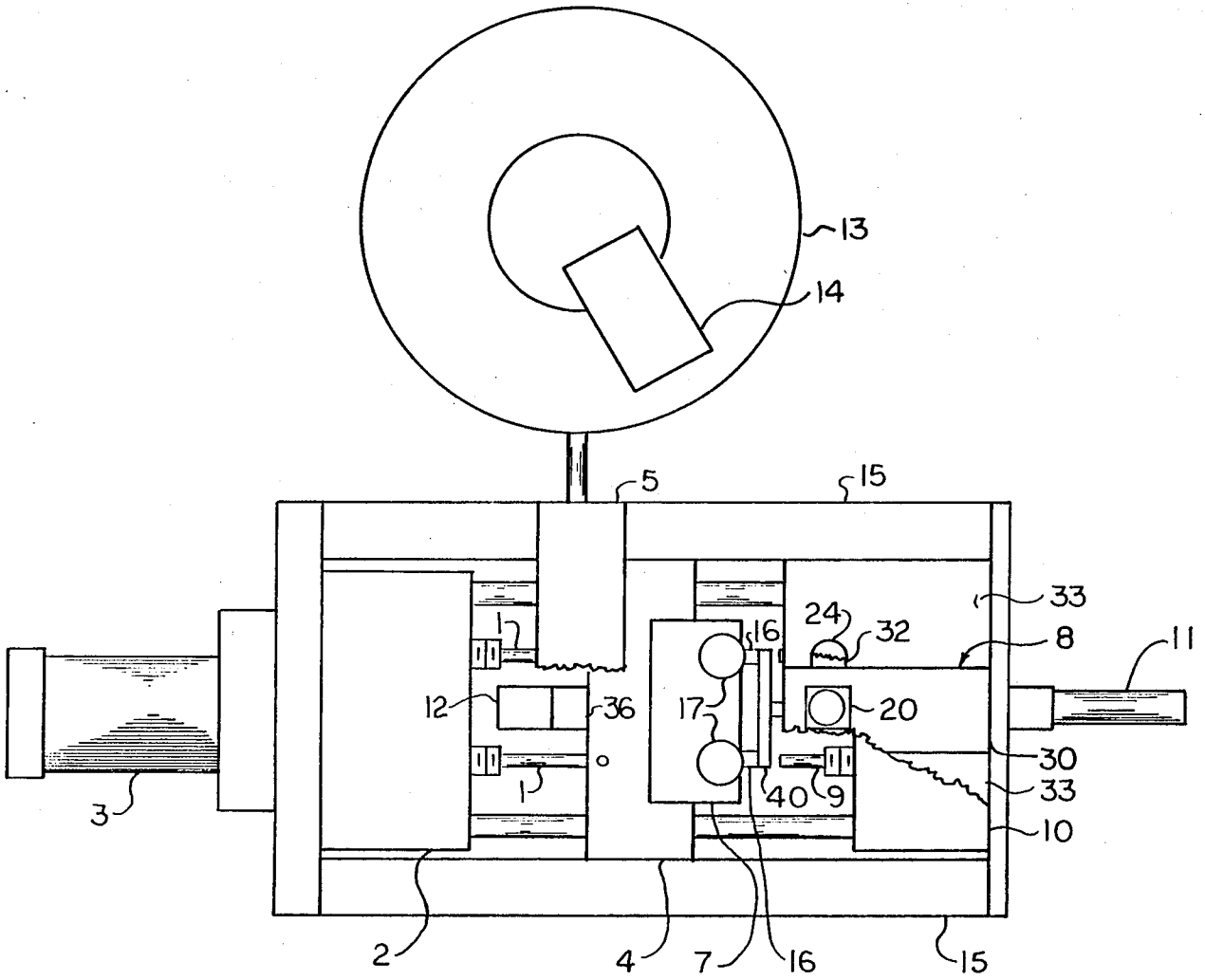
FIG. 3 is a top or plan view of the apparatus of the invention with parts cut away to illustrate some of the operating components of the apparatus.
Figure 4:
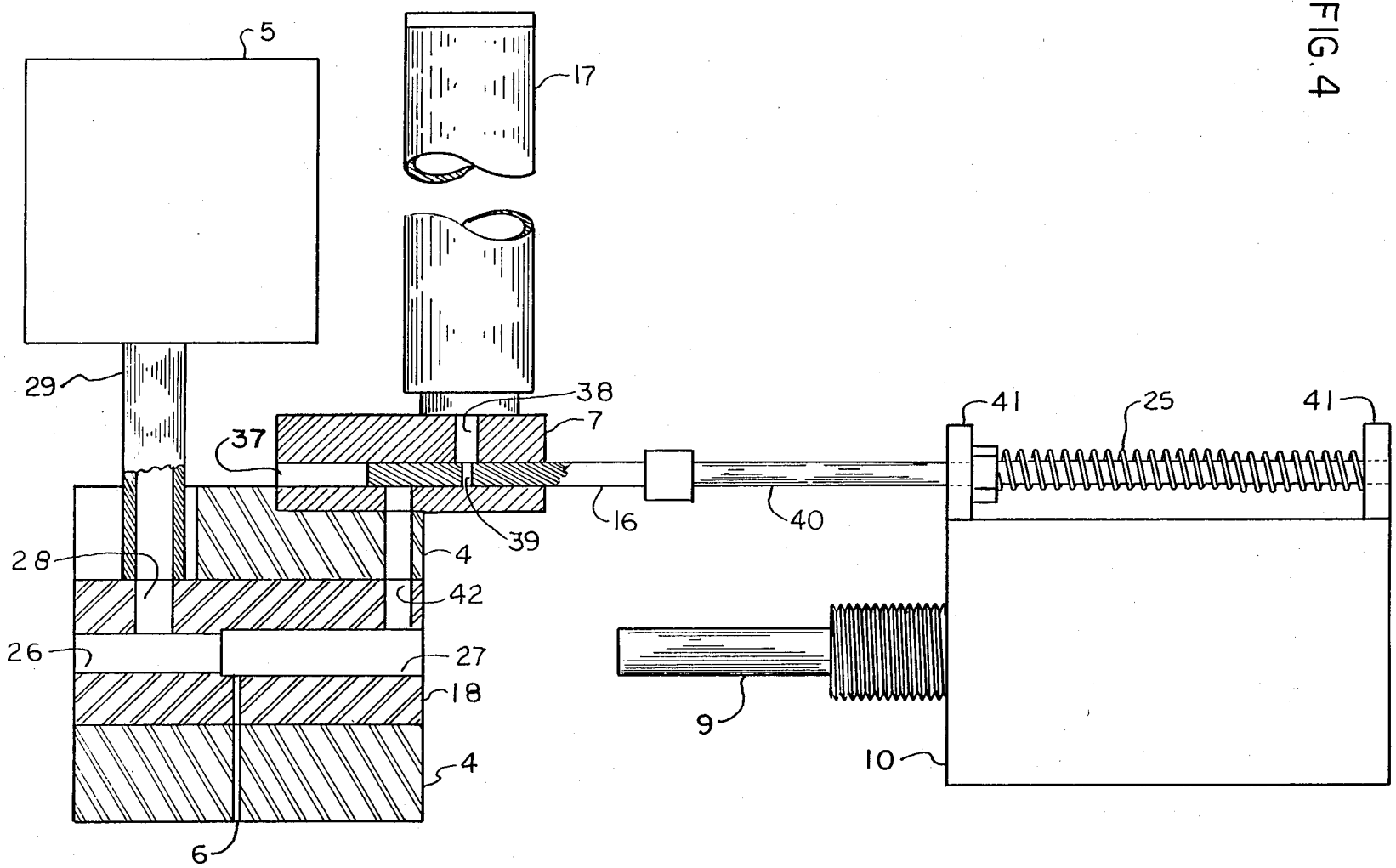
FIG. 4 is a side elevational view, partly in section, of the die and metering device for the lubricant.

Referring first to FIGS. 2 and 3, there is shown an apparatus for producing bullets according to the principles of the invention. The apparatus consists of a supporting frame 15 upon which there is mounted a pair of ram punches 1 operable in the same horizontal plane, which ram punches 1 are secured in spaced apart relationship to a ram punch block 2. Ram punch block 2 is secured to the operating rod of a main hydraulic cylinder 3 so that upon actuation of the hydraulic cylinder 3 the ram punch block 2 will be moved back and forth toward and away from a die block 4 which is mounted centrally of the machine. As best seen in FIG. 4, die block 4 includes a pair of dies 18 each of which is in alignment with one of the ram punches 1. Only one of the dies 18 is shown in FIG. 4, and each die 18 has a horizontally extending passageway 26 the diameter of which is just large enough to receive the ram punch 1. Passageway 26 is in alignment and communication with a passageway 27 that extends through the opposite side of die block 4 so as to receive a top punch 9 as more fully described hereinafter. Each die block 4 also contains a vertical passageway or vent 6 which is in communication with passageway 27. Passageway 26 is in communication with a vertical passageway 28 provided by tube 29 that is connected to a flow control block 5. Flow control block 5 is a metering device that regulates the flow of molten lead into passageways 26, which molten lead is applied by lead pump 14 from a lead melter 13.

Thus, as will be more fully described hereinafter in connection with the operation of the apparatus and description of the process, lead melted in melter 13 is pumped by lead pump 14 into the flow control block 5, with a precise amount being thus metered into passageway 26 for formation into a bullet.

Figure 5:
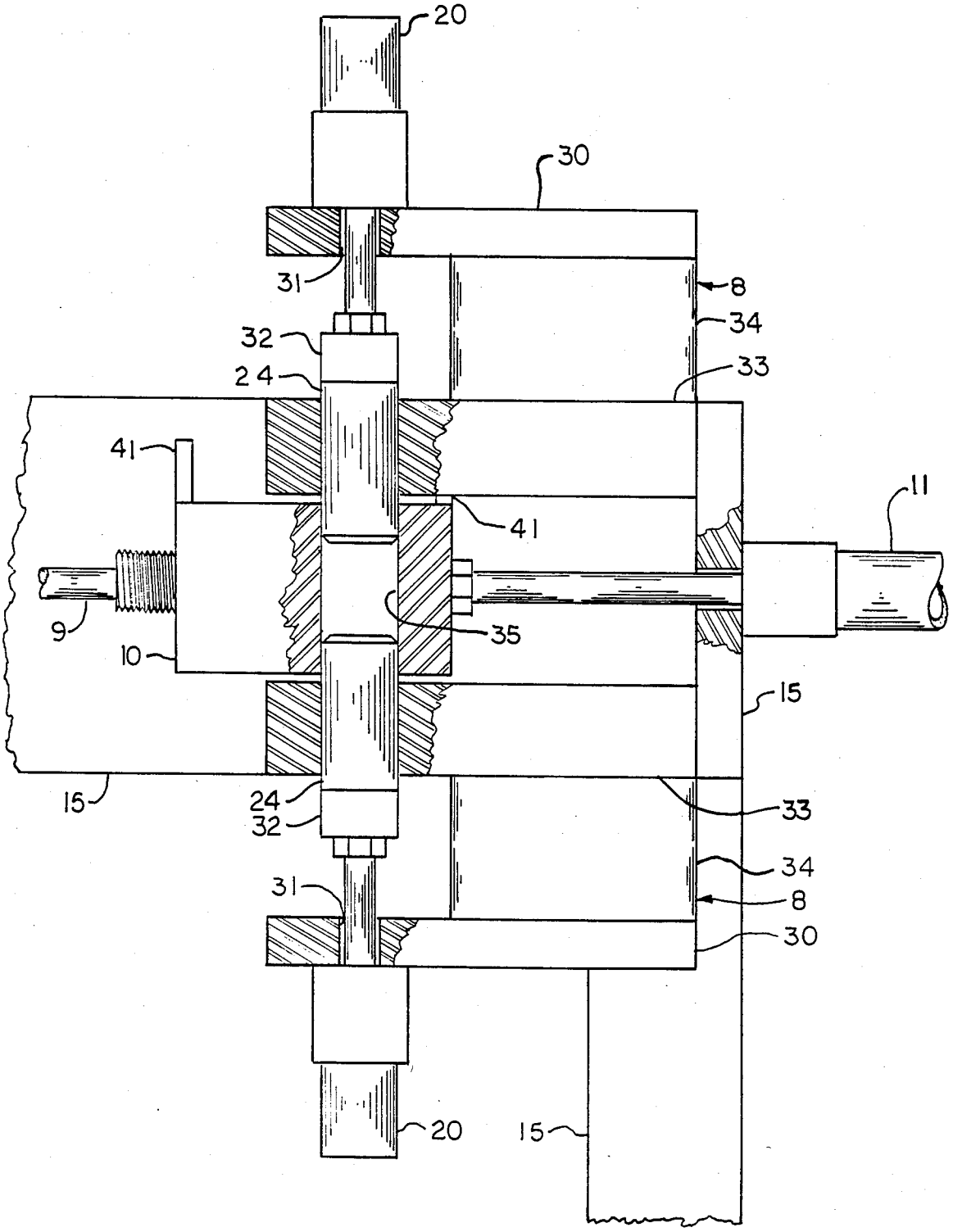
FIG. 5 is a side elevational view, also partly in section and illustrating the locking mechanism for the top punch.

In order to form a bullet from the lead thus fed into passageway 26, the top punch 9 must be moved at the proper time into the passageway 27. Thus, a pair of top punches 9, one for each of the passageways 27 in each of the dies 18, are mounted onto a top punch block 10 which is in turn operatively connected to a hydraulic cylinder 11 for movement toward and away from the die block 4. In order to be effective in the swaging or formation of bullets in the dies 18 the top punches 9 must be locked into position when properly positioned in passageways 27. The locking mechanism for accomplishing this is best seen in FIG. 5 and consists of upper and lower locking mechanisms indicated generally by reference numerals 8. Both the upper and lower locking mechanisms 8 operate in the same manner and therefore only one will be described with identical reference numerals used on the other. Each locking mechanism 8 consists of an outer support plate 30 on which is mounted a hydraulic cylinder 20 the operating rod of which is movable vertically through an opening 31 in the plate 30. The operating rod of hydraulic cylinder 20 is connected to a cross member 32 to which there is connected a pair of locking pins 24, one for each of the top punches 9. Each locking pin 24 extends through an inner support plate 33 connected to support 34, and is maintained in alignment by cross member 30. At best seen in FIG. 5, the locking pins 24 are movable vertically within a limited distance, and in their extended or locking positions extend into openings 35 in the top punch block 10 so as to maintain the position of top punch block 10. Thus, when the hydraulic cylinders 20 are actuated, the locking pins 24 will be moved vertically and inwardly into the locking openings 35 in the top punch block 10. At the proper time as more fully described hereinafter, the locking pins 24 are withdrawn from the locking openings 35 so that the top punch block can be freely moved by actuation of the hydraulic cylinder 11.

There has also been provided a positive stop so that the movement of the ram punch block 2 carrying the ram punches 1 will be limited. As best seen in FIG. 2, a movable stop 12 is movable upwardly and downwardly into andout of the path of the ram punch block 2 by being connected to the operating rod of hydraulic cylinder 23 which is supported in any suitable manner in the position shown in FIG. 2. A stationary vertical member 36 is affixed to the left side (FIG. 2) of the die block 4 to provide support for mounting of the cylinder 23 and also to provide a guide for movement of the stop 12. Thus, when the stop 12 is moved upwardly into the position shown in FIG. 2, it will be in the path of the horizontally moving ram punch block 2 and will thus limit its movement.

In the manufacture of bullets, it is desirable that lubricant be added at the time of the formation of each bullet. In order to provide a metered amount of lubricant into the die 18, a hopper 17 containing the desired lubricant is mounted on a lubricant meter block 7 secured to the top of the die block 4. A horizontal passageway 37 is provided in the lubricant meter block 7 which passageway 37 is in communication with a vertical passageway 38 that allows lubricant from the hopper 17 to flow by gravity down through passageway 38 into passageway 37. In order to meter the amount of lubricant, which is a dry powdered lubricant, there is provided a metering bar 16 movable in passageway 37. Metering bar 16 contains an opening 39 which is of a size to provide the desired amount of lubricant. Metering bar 16 is in turn connected to an operating lever 40 that is in turn connected as shown at 41 to the top punch block 10. Metering bar 16 is biased to the left (FIG. 4) by spring 25. Thus as the punch block 10 is moved inwardly and outwardly, the metering bar 16 will be also moved in passageway 37 to a first position in which the opening 39 is directly beneath the vertical passageway 38 are biased by spring 25 to a second position in which the opening 39 is directly above a vertical passageway 42 in the die block 4 which passageway 42 will allow the lubricant to drop into the interior of the die 18 into passageway 27.

The operation of the foregoing described apparatus and the process for producing bullets utilizing the principles of the invention will now be described. In the initial or start position, the stop member 12 will be retracted by cylinder 23 so as to be out of the path of the ram punch block 2. The ram punch block 2 will be in its extended position with the ram punches 1 extending into the passageway 26 in the dies 18. At this initial or start position, the top punches 9 will be retracted, and the locking pins 24 will be withdrawn by cylinders 20. Thus, with the top punch block 10 withdrawn, the metering bar 16 will be positioned as shown in FIG. 4 in which the opening 39 is beneath the passageway 38 leading to the lubricant hopper 17. Thus, the opening 39 will be filled with lubricant. The positions just described, are those shown in FIG. 2 with the exception of the stop member 12 which is shown in the extended rather than retracted position and ram punch block 2 which is also shown retracted rather than extended.

The main hydraulic cylinder 3 will then be actuated so as to retract the ram punch block 2 and ram punches 1. As the ram punch block 2 is retracted, cylinder 23 will be actuated so as to move the stop 12 to its upper or stop position as shown in FIG. 2. Next, hydraulic cylinder 11 will be actuated so as to move the top punch block 10, and thus the top punches 9 inwardly or to the left as shown in FIG. 2. As top punch block 10 moves inwardly, the metering bar 16 will also be moved to the left by spring 25, thus positioning the opening 39 over the opening 42 dropping the powdered lubricant into the die 18. As the top punch block 10 continues its advance inwardly, and with the lubricant now in passageway 27, continued movement of the top punch block 10 inwardly will move the top punches 9 into the passageways 27 in dies 18. When movement of the top punch block 10 inwardly will move the top punches 9 into the passageway 27 in dries 18. When movement of the top punch block 10 inwardly has been completed, hydraulic cylinders 20 will be actuated thereby causing the locking pins 24 to be moved into a locking position in the openings 35 in the top punch block 10. The top punch block 10, and thus the top punches 9, are now securely positioned and locked into place.

Lead pump 14 is actuated to pump a precise amount of lead from the lead melter 13 into the flow control block 5 from where it flows through passageways 28 into each of the passageways 26 in dies 18. When the molten lead is thus injected into the dies 18, it will start to solidify. The hydraulic cylinder 3 is then actuated to push the ram punch block 2 and the ram punches 1 inwardly (to the right of FIG. 2) until the ram punch block 2 engages the stop member 12 at which time the advance of the ram punches 1 ceases. As the ram punches 1 are thus moved inwardly, they move into the passageways 26 in dies 18 containing the now solidified but still soft lead, and as the ram punches 1 continue their inward movement, a bullet is formed in each of the dies 18. At this time, the pressure applied to the "plastic" lead is approximately 35,000 pounds per square inch. As each bullet in die 18 is formed, the lubricant that was previously dropped into the dies 18 is forced into the surface of the newly formed bullet, and any excess lead is discharged through vent 6. At this point, the bullets are formed, but it is necessary to eject them from the dies 18. In order to accomplish ejection of the newly formed bullets, the stop cylinder 23 is actuated to retract the stop member 12 downwardly and out of the way of the ram punch block 2. Simultaneously, the hydraulic cylinders 20 are actuated to retract the locking pins 24 from the opening 35 in the top punch block 10. Hydraulic cylinder 11 is then actuated to retract the top punch block 10 and move it outwardly thereby removing the top punches 9 from the dies 18. At the same time, the metering bar 16 is returned to its initial position with the opening 39 beneath passageway 38 leading to the lubricant hopper 17.

With the top punches 9 withdrawn from passageways 27 in dies 18, and with the stop member 12 moved downwardly out of the path of the ram punch block 2, hydraulic cylinder 3 is further actuated to move the ram punches 1 further inwardly (to the right of FIG. 2) and into passageways 27 of dies 18 in order to eject the completed bullets out of the dies 18. I have indicated in FIG. 2 a tray 19 to receive the ejected bullets as they are formed. At this point, all of the various components of the apparatus are in the initial or start position and the cycle is repeated.

Figure 1:
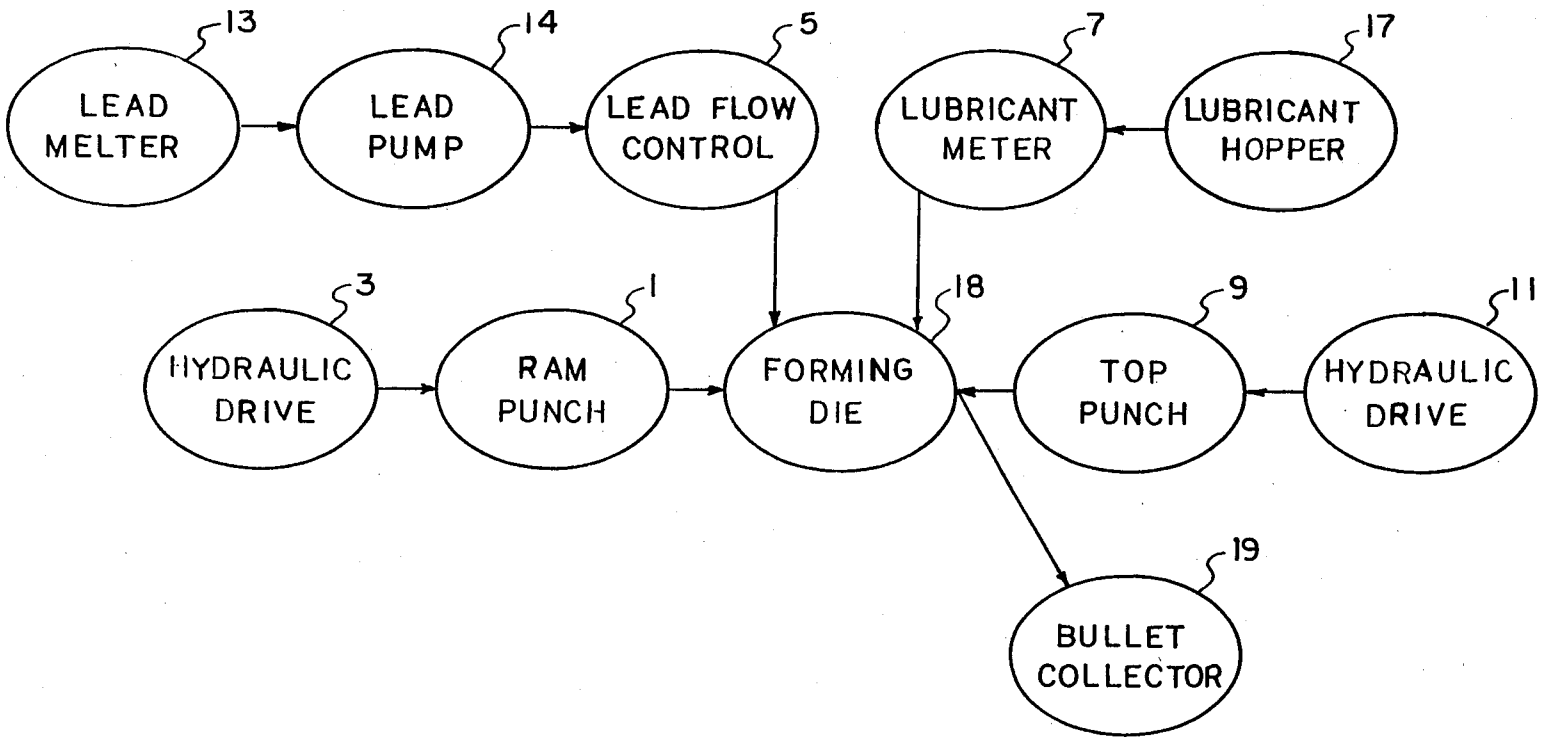
FIG. 1 is a schematic diagram illustrating the steps involved in the process of the invention.

All of the foregoing steps and the timing of them can be controlled in any suitable manner. It is preferred that the timing be controlled by a suitable programmable controller that will control actuation of the various hydraulic cylinders and the lead pump in the foregoing described sequence. It should be understood that the foregoing described sequence occurs very rapidly so that the maximum production rate can be achieved. In actual practice, using a machine that contains two dies and thus permits the formation of two bullets during each cycle, number of bullets can be produced per hour. Obviously, by increasing the number of dies in a particular machine, this productivity can be increased manyfold. The invention however has for simplicity purposes been described with a basic machine which however is capable of producing bullets at a rate and cost comparable to more expensive commercially available machines which utilize an extrusion or typical casting process. The process of the invention is illustrated schematically in FIG. 1 which shows the basic steps of the process.

Using the apparatus and method of the invention, it will be evident that the bullets are formed by a rapid die casting process which produces a hardened bullet and thus one that is preferred over the softer bullets produced by the extrusion process. The process is such that there is no handling whatsoever required from the time that the lead is placed into the melter and the finished bullets ejected from the dies. It is thus a continuous process that enables a high quality hard or soft bullet to be produced at a lower cost than the typical commercially available machines. Also, because of the simple and easy manner in which the lubricant is added and impregnated into the surface of the bullet under extreme pressure, bullets of improved quality are produced using the method and apparatus of the invention.

Having thus described the invention in connection with a preferred embodiment thereof, it will be evident to those skilled in the art that various revisions and modifications can be made to the method and apparatus described herein without departing from the spirit and scope of the invention. It is my intention however that all such revisions and modifications as are evident to those skilled in the art will be included within the scope of the following claims.

What is claimed is:

1. An apparatus for making small lead objects such as bullets, said apparatus comprising a forming die for the object to be produced, said die having two open ends means for supplying a measured amount of lubricant into the forming die in the vicinity of one of said open ends, a first ram punch movable into and out of one of said open ends of the forming die, a second ram punch movable into and out of the other of said open ends of the forming die, means for supplying a predetermined amount of flowable lead into the forming die, means for causing the ram punches to exert high pressure on the lead in the die, control means for controlling the supply of lubricant and lead and the movement of the ram punches in timed sequence so as to apply high pressure to the lead in the forming die while the lead is still in a plastic state, and means to eject a formed object from the forming die after the object is formed.

2. The apparatus of claim 1 in which the first ram punch and the second ram punch are movable into and out of the forming die from opposite directions.

3. The apparatus of claim 1 in which the movement of the first ram punch inwardly toward the forming die also forces the measured amount of lubricant into the forming die.

4. The apparatus of claim 3 further comprising locking means to lock the first ram punch in a forming position after the lubricant is forced into the forming die.

5. The apparatus of claim 4 further comprising stop means to limit inward movement of the second ram punch toward the forming die during the formation of the object, and means to disable the stop means to allow the second ram punch to move further inwardly to eject the formed object after withdrawal of the first ram punch.

* * * * *